United States Patent [19]

Koncelik et al.

[11] 4,360,240

[45] Nov. 23, 1982

[54] MODULAR STORAGE UNITS

[75] Inventors: Joseph A. Koncelik, Worthington; David B. Chaney, Powell, both of Ohio; Walter G. Lockard, Quakertown, Pa.

[73] Assignee: Burlington Industries, Inc., Greensboro, N.C.

[21] Appl. No.: 188,474

[22] Filed: Sep. 18, 1980

[51] Int. Cl.[3] ..... A47B 81/00; E06B 9/14

[52] U.S. Cl. ..... 312/238; 312/239; 312/297; 108/59

[58] Field of Search ..... 312/238, 297, 239, 295, 312/235 R; 108/59, 64

[56] References Cited

U.S. PATENT DOCUMENTS

| | | | |
|---|---|---|---|
| 164,640 | 6/1875 | Coburn . | |
| 204,956 | 6/1878 | Doyle | 312/238 |
| 217,682 | 7/1879 | Dewing . | |
| 835,701 | 11/1906 | Burford . | |
| 2,206,347 | 7/1940 | Derman | 312/297 |
| 2,575,530 | 11/1951 | Reid | 312/238 |
| 2,617,055 | 11/1952 | Reinheimer et al. | 312/238 |
| 3,160,451 | 12/1964 | Lewis | 312/239 |
| 3,330,611 | 7/1967 | Heifetz | 312/297 |
| 3,807,825 | 4/1974 | Snethen | 312/297 |
| 3,899,228 | 8/1975 | Schreiber . | |
| 4,217,012 | 8/1980 | Klaus | 312/297 |
| 4,279,454 | 7/1981 | Koiso et al. | 312/297 |

FOREIGN PATENT DOCUMENTS

| | | | |
|---|---|---|---|
| 2410982 | 10/1979 | France | 312/238 |
| 111183 | 5/1967 | Norway | 108/59 |
| 865794 | 4/1961 | United Kingdom | 312/238 |

*Primary Examiner*—Victor N. Sakran

*Attorney, Agent, or Firm*—Cushman, Darby & Cushman

[57] ABSTRACT

An assembly for storing clothing or other articles is provided, especially adapted for use in nursing homes or the like by non-ambulatory residents. First and second wall panels are mounted to each other so that they are perpendicular. A storage structure defined by a right triangular prism is provided including a plurality of walls defining a storage area therebetween with the front wall having an access opening. A tambour door is slidable on a pair of tracks to selectively block and unblock the access opening in the storage structure. The storage structure is mounted to the wall panel so that the tambour door tracks are disposed in horizontal planes vertically spaced from each other, and so that the storage structure is spaced from the ground, along the entire extent thereof, a distance corresponding to the height of a toeboard of a wheelchair off of the ground. A generally U-shaped handle is disposed along the entire length of the tambour door with both legs of the U extending outwardly from the storage structure, facilitating use by non-ambulatory and arthritic persons.

7 Claims, 6 Drawing Figures

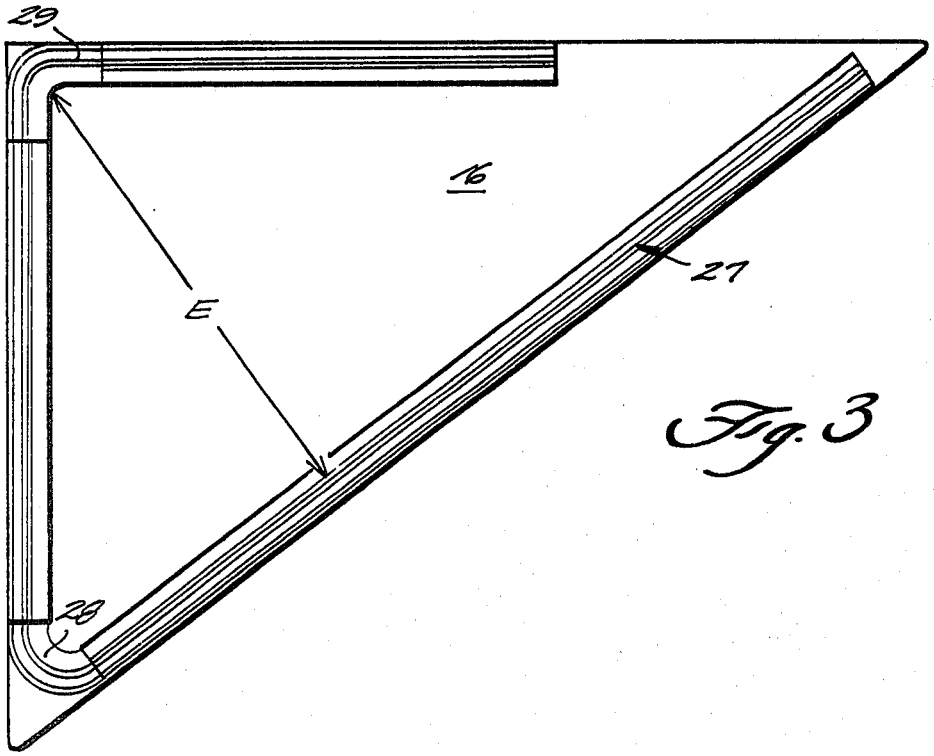
Fig. 3
Fig. 2
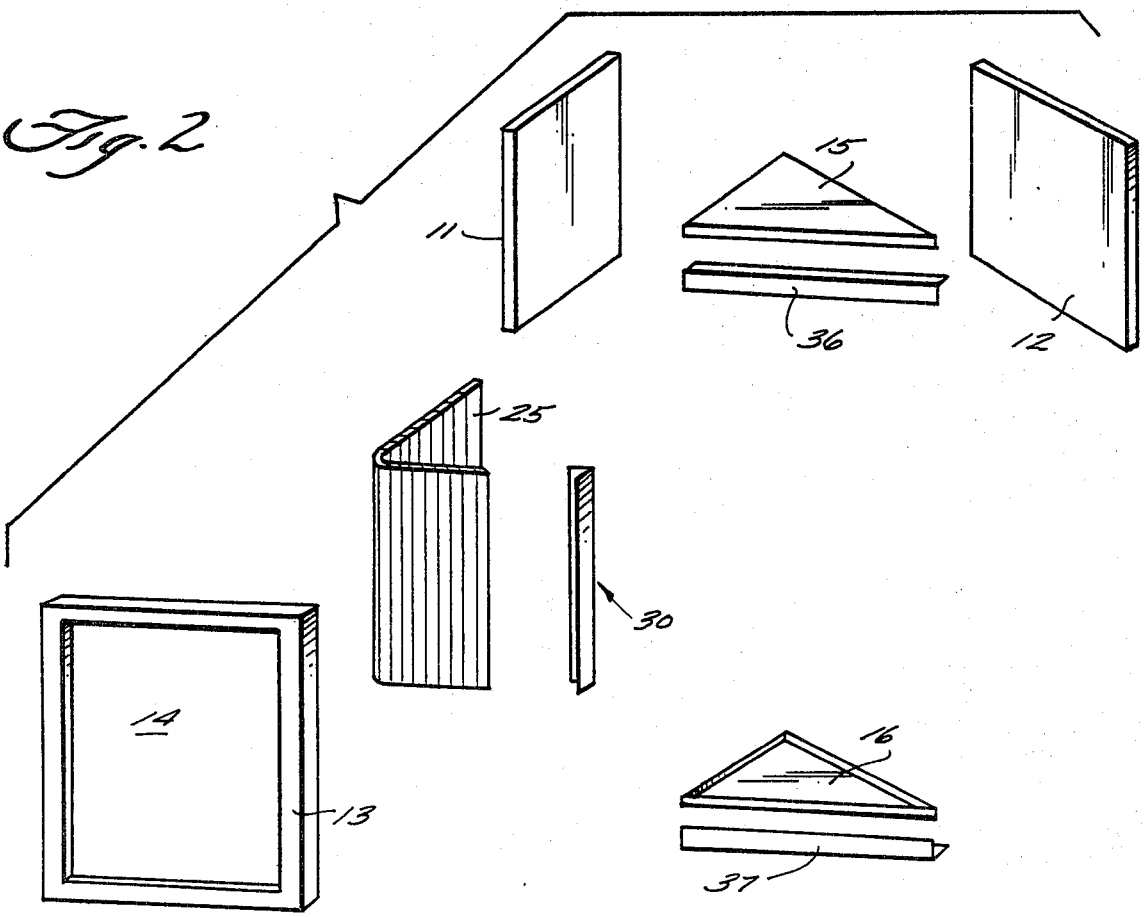

MODULAR STORAGE UNITS

BACKGROUND AND SUMMARY OF THE INVENTION

The invention relates to a modular storage unit in general, and in particular an assembly for storing clothing or other articles that is especially adapted for use with the room dividing system illustrated and described in copending application Ser. No. 136,095 filed Mar. 31, 1980 now U.S. Pat. No. 4,332,042, the disclosure of which is hereby incorporated by reference herein. While the assembly according to the present invention has other uses than in a nursing home environment, it is particularly adapted to take into account the needs and desires of aging people. The assembly according to the present invention helps provide safety, comfort, control, and a sense of personal ownership for aging people when utilized in a nursing home environment.

The storage unit according to the present invention is constructed to be mounted on a pair of substantially perpendicular wall panels, which wall panels provide part of the definition of a room environment. Mounted in this manner, it does not interfere with activities in the room environment, and it provides a distinct area of personalization for the resident. All of the exterior corners of the unit are rounded for safety, and it is mounted on the wall panels spaced from the ground along the entire extent thereof a distance corresponding to the height of a toeboard of a wheelchair off of the ground. This accommodates the unit for use by non-ambulatory residents.

Further adaptation of the storage unit for use by non-ambulatory residents is provided in the dimensioning and access arrangements for the storage units. In particular, the unit is dimensioned so that it is only as deep as can be conveniently reached by an individual while sitting in a wheelchair. Further, in one embodiment the access opening is selectively blocked or unblocked by a tambour door having an elongated handle disposed along the entire length of one edge thereof. The handle serves as a positive stop for door movement and additionally is designed to provide surfaces that may be readily acted upon by the resident to readily effect movement of the door. The provision of the tambour door and the elongated door handle allow a non-ambulatory resident to open or close the unit without repositioning their wheelchair for each task, allowing the door to be readily pushed or pulled. Additionally, any hanger bar provided in the structure is mounted at a height allowing one in a wheelchair to utilize the hanger bar while remaining seated.

According to one aspect of the present invention, an assembly for storing clothing or other articles is provided. The assembly comprises a first wall panel, a second wall panel mounted to the first wall panel so that they are substantially perpendicular to each other, and a storage structure including a plurality of walls defining a storage area therebetween. The storage structure has a polygon shape in cross-section and includes a front wall having an access opening defined therein. Means are provided for selectively blocking or unblocking the access opening, said means comprising a tambour door, and a pair of rail structures for mounting the tambour door along two sides thereof on opposite sides of the access opening are provided, the rail structures having at least two 90° turns defined thereby and disposed within the interior of the storage structure. Means are also provided for mounting the storage structure to the wall panel so that the tambour door tracks are disposed in horizontal planes vertically spaced from each other, and so that—in conjunction with the dimensioning of the storage structure—the storage structure is spaced from the ground along the entire extent thereof a distance corresponding to the height of a toeboard of a wheelchair off of the ground so that a resident in a wheelchair may readily approach the storage structure without hinderance. A handle for the tambour door extends substantially the entire length of the door, and means are provided for mounting the handle to the door so that the handle acts as a stop for door movement to both the open and closed positions. The handle preferably has a general U-shape in cross-section; a pair of legs are connected by a flattened portion, both of the legs extending outwardly from the storage structure a distance sufficient for an individual to place the palm or edge of their hand against the leg to effect movement of the tambour door. This allows ready use by both non-ambulatory and arthritic residents since there is no necessity for grasping, and since the door can be acted upon along any part of the length thereof.

According to another aspect of the present invention a storage unit for storing clothing or other articles is provided. The storage unit comprises a plurality of rigid walls rigidly attached together defining a right triangular prism defining a storage area, the wall defining the hypothenus of the right triangular prism having an access opening formed therein. The access opening may be opened, allowing access to a plurality of shelves disposed within the unit, or the access opening may be selectively blocked or unblocked by the slideable tambour door as previously described. All exterior corners of the device are rounded for safety.

It is the primary object of the present invention to provide a simple and efficient assembly or unit for storing clothing or other articles, especially adapted for use by nursing home residents. This and other objects of the invention will become clear from an inspection of the detailed description of the invention, and from the appended claims.

BRIEF DESCRIPTION OF THE DRAWINGS

FIG. 2 is an exploded perspective view of major components of the storage unit illustrated in FIG. 1;

FIG. 3 is a top plan view of the bottom constructional component of the storage unit illustrated in FIG. 1;

FIG. 4 is a top plan view of a preferred handle utilizable with the tambour door of the structure illustrated in FIG. 1;

FIG. 5 is a perspective view of an exemplary storage unit according to the present invention shown as part of a personalized environmental setting for a nursing home or the like.

DETAILED DESCRIPTION OF THE DRAWINGS

Figure 1:
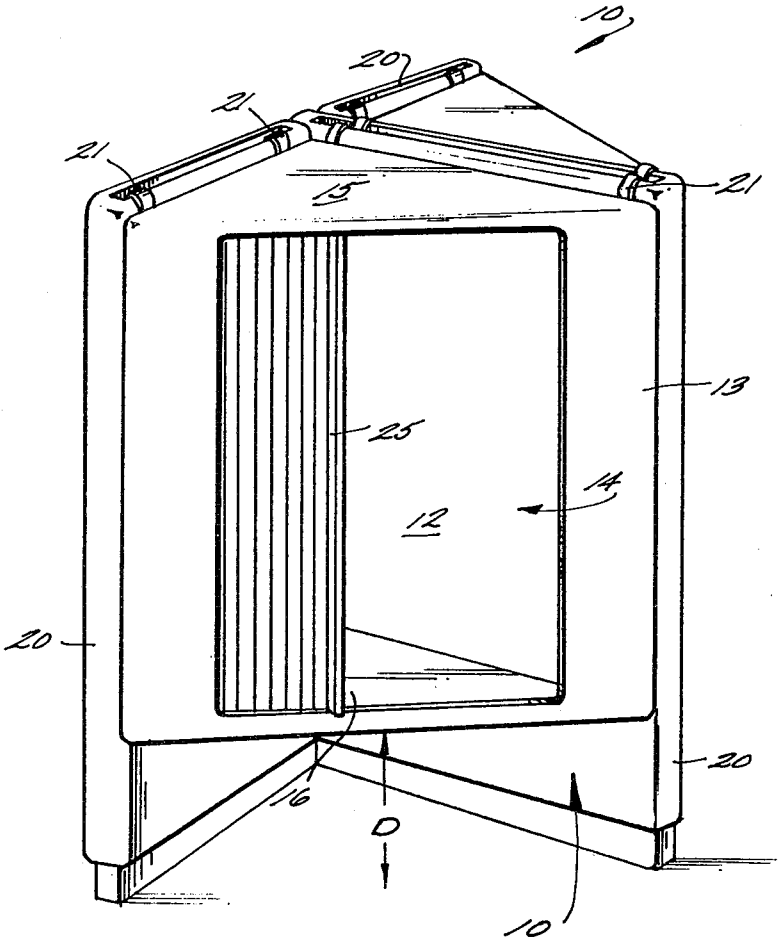
FIG. 1 is a perspective view of an exemplary clothes supporting assembly according to the present invention.
Figures 4, 5:
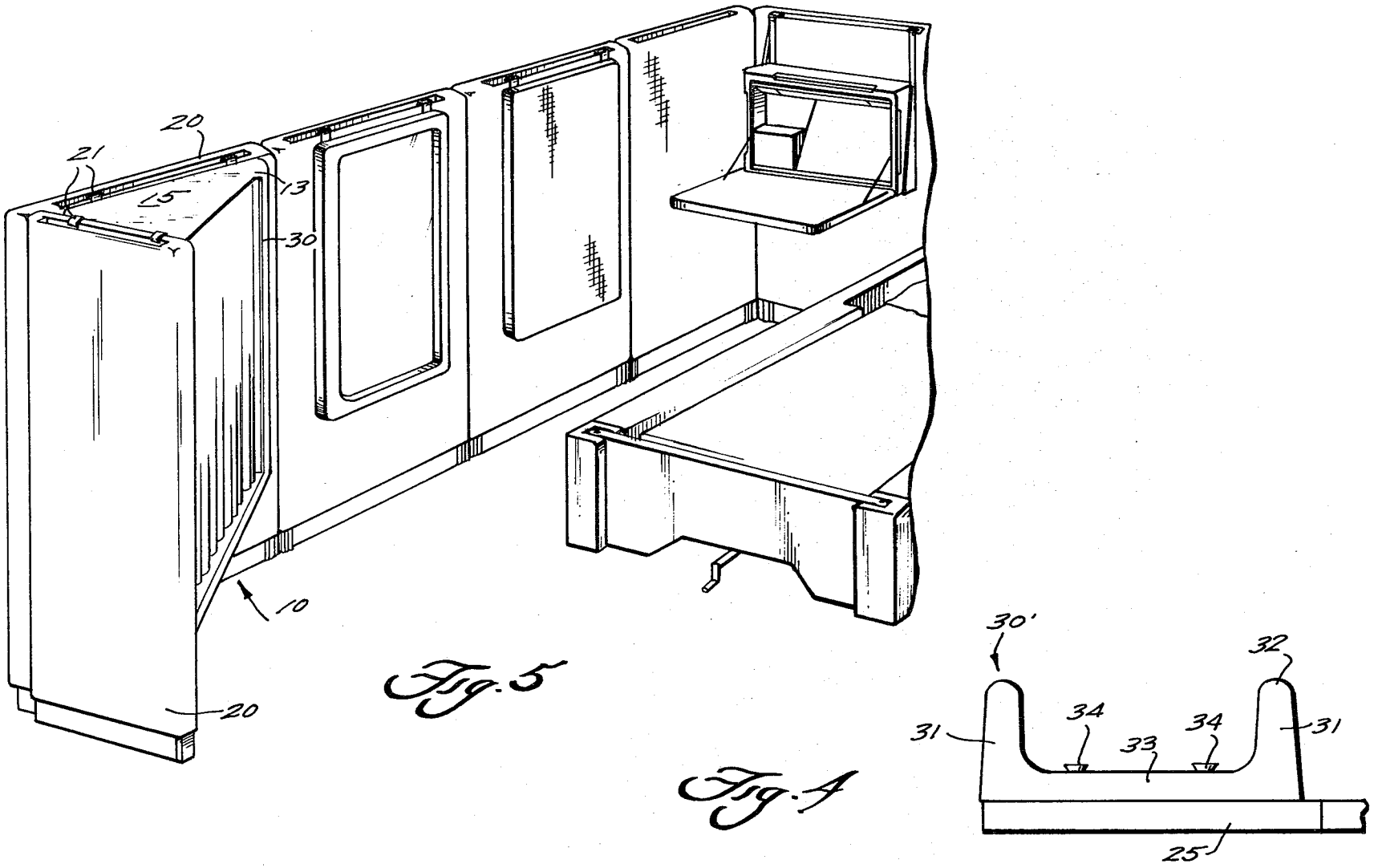

An exemplary assembly for storing clothing or other articles, according to the present invention, is illustrated generally at 10 in the drawings (see FIGS. 1 and 5 in particular). The storage structure 10 includes a plurality of walls defining a storage area therebetween, such as side walls 11 and 12, front wall 13 having an access opening 14 defined therein, and top and bottom walls 15, 16 (see FIG. 2 in particular). The storage structure 10 has a polygon shape in cross-section, preferably being a right triangular prism as illustrated in the drawings, with the wall (13) defining the hypothenus of the right triangular prism having the access opening 14 formed therein.

The storage unit 10 is adapted to comprise part of an assembly including wall panels 20 mounted so that they are substantially perpendicular to each other, as illustrated most clearly in FIGS. 1 and 5. The wall panels 20, which are more fully described in said copending application Ser. No. 136,195 (the disclosure of which has been incorporated by reference herein) are comparable to conventional upholstered panels for dividing work areas in office space, such as those sold by J. G. Furniture, a division of Burlington Industries, of Quakertown, Pa., under the name "UPS". Conventional panel joining hardware is utilized to attach the panels 20 together. Conventional hangers 21 are provided for mounting the storage structure 10 to the wall panels 20 so that they storage structure is spaced from the ground along the entire extent thereof a distance D corresponding to the height of a toeboard of a wheelchair off of the ground, whereby access to the storage structure 10 by an individual in a wheelchair is readily provided. The distance D preferably will be a minimum of about 8 inches. Unit 10 is also designed so that one in a wheelchair may reach all portions of the unit while sitting in a wheelchair. That is the depth E (see FIG. 3) of the unit 10 is about 16 inches.

The storage unit 10 also comprises means for selectively blocking or unblocking the access opening 14, such means comprising a conventional tambour door 25, such as a HERCULEX tambour door. Rail or track means are provided for mounting the tambour door 25 for movement to selectively block or unblock the access opening 14, such rail or track means including a pair of rail or track structures operatively connected to the walls 15 and 16. One such rail or track structure is shown at 27 in FIG. 3, in association with bottom wall 16, and the other rail or track structure associated with top wall 15 is substantially identical to rail or track 27. The rail or track 27 includes at least two 90° (or greater) turns 28, 29. Preferably the rail or track 27 will be a HERCULEX plastic track. The hangers 21 (which may be rigidly attached to unit 10 by adhesive, screws, or the like at walls 11 and 12) mount the unit 10 on the wall panels 20 so that the tracks 27 are disposed in horizontal planes vertically spaced from each other, the tambour door 25 moving horizontally to selectively block or unblock the access opening 14. Such an arrangement provides for the advantages of a tambour door while still allowing actuation by a person in a wheelchair (which would not be provided if the tambour door moved vertically, as is conventional in structures utilizing tambour doors).

A handle 30 is provided for the tambour door 25 extending the full length thereof so that the door may be moved by engaging it at any location along the height of the unit 10. The handle 30 is designed to be readily pulled or pushed, and acts as a stop for door movement in either direction. The handle 30 is shown having a right-angle configuration in FIG. 2. The handle 30' in FIG. 4 has another configuration also facilitating ready pulling or pushing, and accomplishing the objectives of easy actuation by aged persons, even those having arthritic conditions.

The handle 30', as illustrated in FIG. 4, has a generally U-shape in cross-section, and extends substantially the entire length of the door 25. In particular, legs 31 are provided, having rounded tops 32, and interconnected by a flattened portion 33. The flattened portion is mounted to the door 25 so that both legs 31 extend outwardly from the unit 10. Mounting may be accomplished utilizing a plurality of screws 34 or the like. The legs 31 act as stops for movement of the door 25 both to the blocking and unblocking positions, the legs 31 abutting portions of the wall 13 defining the access opening 14 at their end positions. The legs 31 extend outwardly from the door 25 a distance sufficient for an individual to place the palm or edge of their hand against the leg to effect movement of the tambour door. This facilitates use by persons having arthritic conditions for whom grasping is difficult. For instance the legs 31 may extend outwardly from the door 25 a distance of about 1 inch (extending outwardly from flattened portion 33 a distance of about $\frac{3}{4}$ of an inch). A desired material of construction of the handle 30' is fire-retardant rigid plastic.

The various components of the storage unit 10 can be connected together in any desirable manner, such with angle members 36, 37 (see FIG. 2) and suitable fasteners, adhesive, and/or the like.

Figure 6:
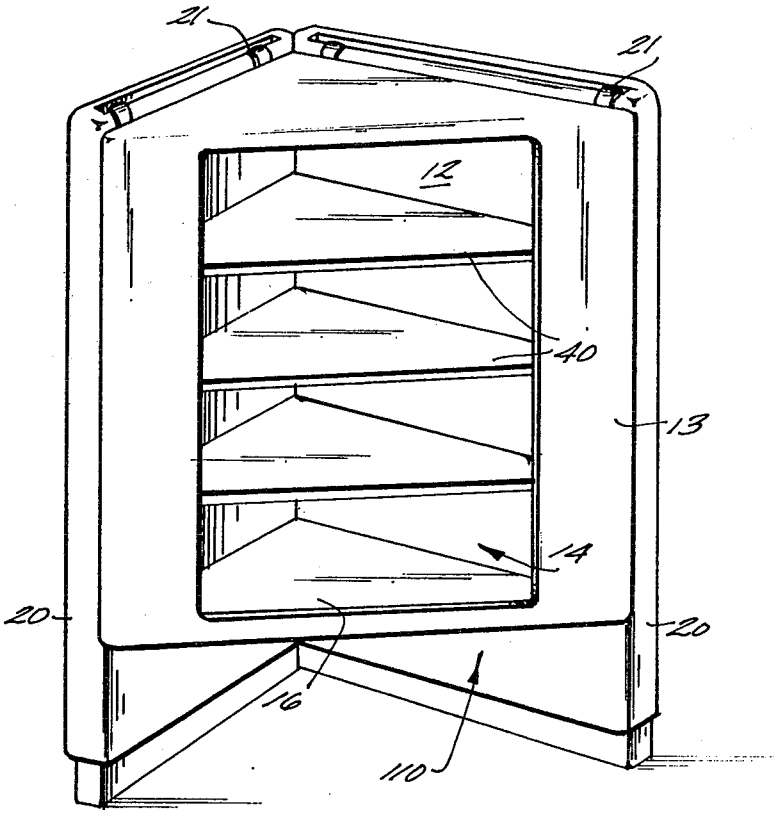
FIG. 6 is a perspective view of a shelfed article supporting unit.

A unit 10 according to the present invention is illustrated in conjunction with various other components in an exemplary nursing home room division area in FIG. 5. It is noted that mounted as it is, the unit 10 will not interfere with movements of wheelchairs, walkers, portable emergency equipment, or the like in the room environment, yet provides a distinct feeling of comfort and personalization and ownership for the resident. The unit 10 is particularly adapted for personal belongings which need to be hung vertically (e.g. bathrobes, dresses, shirts, etcetera), while the base thereof can accommodate the storage of a pair of slippers or shoes. Any hanger bar utilized is mounted (preferably to side walls 11, 12 or hung from top wall 15) so that it is at a height allowing ready access of the resident to the articles hung thereby. Where a series of panels 12 provide a common division for two room environments, it may be desirable to mount storage units 10 back-to-back, as illustrated in FIG. 1.

Where it is desirable to provide the storage unit for the storage of bedding, personal belongings, collectables for display, etcetera, the storage unit may take the form of the unit 110 illustrated in FIG. 6. Like reference numerals utilized in reference to the unit 110 correspond to the structures described with respect to unit 10. The unit 110 differs primarily from the unit 10 in that no tambour door 25 is provided for closing off the access opening 14, and a plurality of shelves 40 are provided for dividing up the storage area defined by the unit 110. The hangers 21 hang the unit 110 on the panels 20 so that the shelves 40 are substantially horizontal.

It is noted that both the units 10 and 110 illustrated in the drawings are constructed so that they are symmetrical so that they may be hung with either the wall 15 or the wall 16 providing the "top" of the device when in use. This is convenient in providing versatility of use of the units 10, 110 in differing room environments, which room environments can assume a wide variety of configurations.

It will thus be seen that according to the present invention an assembly and unit have been provided for storing clothing or other articles taking into account the needs of aged people occupying nursing homes, and significantly contributing to the safety, comfort, control, and sense of personal ownership of such individuals. While the invention has been herein shown and described in what is presently conceived to be the most practical and preferred embodiments thereof, it will be apparent to those of ordinary skill in the art that many modifications may be made thereof within the scope of the invention, which scope is to be accorded the broadest interpretation of the appended claims so as to encompass all equivalent assemblies and devices.

What is claimed is:

1. An assembly for storing clothing or other articles in a nursing home or the like and comprising: a first wall panel; a second wall panel mounted to said first wall panel so that they are substantially perpendicular to each other; a storage structure including a plurality of walls defining a storage structure having a polygon shape in cross-section, said structure including a front wall having an access opening defined therein; means for selectively blocking or unblocking said access opening, said means comprising a tambour door; a pair of track structures for mounting said tambour door along two sides thereof on opposite sides of said access opening, said track structures having at least two 90° turns defined thereby and disposed within the interior of said storage structure; and means for mounting said storage structure to said wall panels so that said tambour door tracks are disposed in horizontal planes vertically spaced from each other, said mounting means comprising hanger means for hanging said storage structure on said wall panels.

2. An assembly as recited in claim 1 wherein said storage structure is so dimensioned and said hanger means are so provided that said storage structure is spaced from the ground, along the entire extent thereof, a distance corresponding to the height of a toeboard of a wheelchair off of the ground, whereby access to said storage structure by an individual in a wheelchair is readily provided.

3. An assembly as recited in claim 1 wherein said storage structure comprises a right triangular prism, with the wall defining the hypothenus of the right triangular prism having said access opening formed therein.

4. An assembly as recited in claims 2 or 3 further comprising a handle for said tambour door, said handle extending substantially the entire length of said tambour door, and means being provided for mounting said handle to said door so that said handle acts as a stop for door movement to both the open and closed positions.

5. An assembly as recited in claim 4 wherein said handle further comprises an elongated member having a generally U-shape in cross-section, and wherein said means for mounting said handle to said tambour door being provided so that both of the legs of said U extend outwardly from said storage structure a distance sufficient for an individual to place the palm or edge of their hand against a leg to effect movement of said tambour door.

6. An assembly as recited in claim 2 wherein said storage structure is only as deep as can be conveniently reached by an individual while sitting in a wheelchair.

7. A storage unit combination for storing clothing or other articles, and comprising: a plurality of rigid walls rigidly attached together defining a right triangular prism defining a storage area, the wall defining the hypothenus of the right triangular prism having an access opening formed therein; a plurality of shelves disposed therein; first and second wall panels disposed substantially perpendicular to each other; and a plurality of hangers for hanging said storage unit on said wall panels so that said shelves are substantially horizontal and said storage unit is spaced from the ground the entire extent thereof a distance corresponding to the height of a toeboard of a wheelchair off of the ground, whereby access to said storage unit by an individual in a wheelchair is readily provided.

* * * * *